United States Patent [19]

Youkstetter

[11] 4,358,110

[45] Nov. 9, 1982

[54] BALANCING GAME APPARATUS

[76] Inventor: Frank O. Youkstetter, 7328 Creek View, West Bloomfield, Mich. 48033

[21] Appl. No.: 197,638

[22] Filed: Oct. 16, 1980

[51] Int. Cl.[3] ..... A63F 9/00

[52] U.S. Cl. ..... 273/1 GC; 273/1 GF

[58] Field of Search ..... 273/1 GF, 1 GG, 1 GC; 434/302

[56] References Cited

U.S. PATENT DOCUMENTS

| | | | |
|---|---|---|---|
| D. 190,504 | 6/1961 | Rosenfeld | D21/102 |
| 2,460,146 | 1/1949 | Prentice | 273/1 GC |
| 2,581,644 | 1/1952 | Frick | 273/1 GC |
| 3,158,370 | 11/1964 | Pearson, Jr. | 273/1 GC |
| 3,402,929 | 9/1968 | Glass et al. | 273/1 GF |
| 3,559,989 | 2/1971 | Breslow | 273/1 GF |
| 3,567,221 | 3/1971 | Stults | 273/1 GF |
| 3,572,704 | 3/1971 | Glass et al. | 273/1 GC |
| 3,614,106 | 10/1971 | Morrison et al. | 273/1 GF X |
| 3,656,746 | 4/1972 | Breslow | 273/1 GF |
| 3,744,792 | 7/1973 | McClary | 273/1 GF |
| 3,764,134 | 10/1973 | Reinertsen | 273/1 GF |
| 3,960,376 | 6/1976 | Berlin | 273/1 GF |

FOREIGN PATENT DOCUMENTS

| | | | |
|---|---|---|---|
| 1122375 | 5/1956 | France | 273/1 GF |

*Primary Examiner*—Paul E. Shapiro

*Attorney, Agent, or Firm*—Gifford, VanOphem, Sheridan and Sprinkle

[57] ABSTRACT

A game of skill and strategy wherein weighted elements are placed on extending arms attached to a central balancing portion supported above a column. The weights must be carefully distributed so that the arms do not lean too far in one direction so as to close an electrical circuit and actuate a signal device. Conveniently, a battery is located within the central column and a signal device such as a light is mounted atop the central portion to detect closing of the electrical circuit and the player's errant attempt to balance the device. A plurality of dice are rolled to determine on which of the depending arms the weighted elements must be hung. Higher scores are awarded for balancing the weights toward the ends of the extending arms. Challenge cards may also be used to challenge a particular distribution of weights on the game device.

24 Claims, 7 Drawing Figures

Fig-6
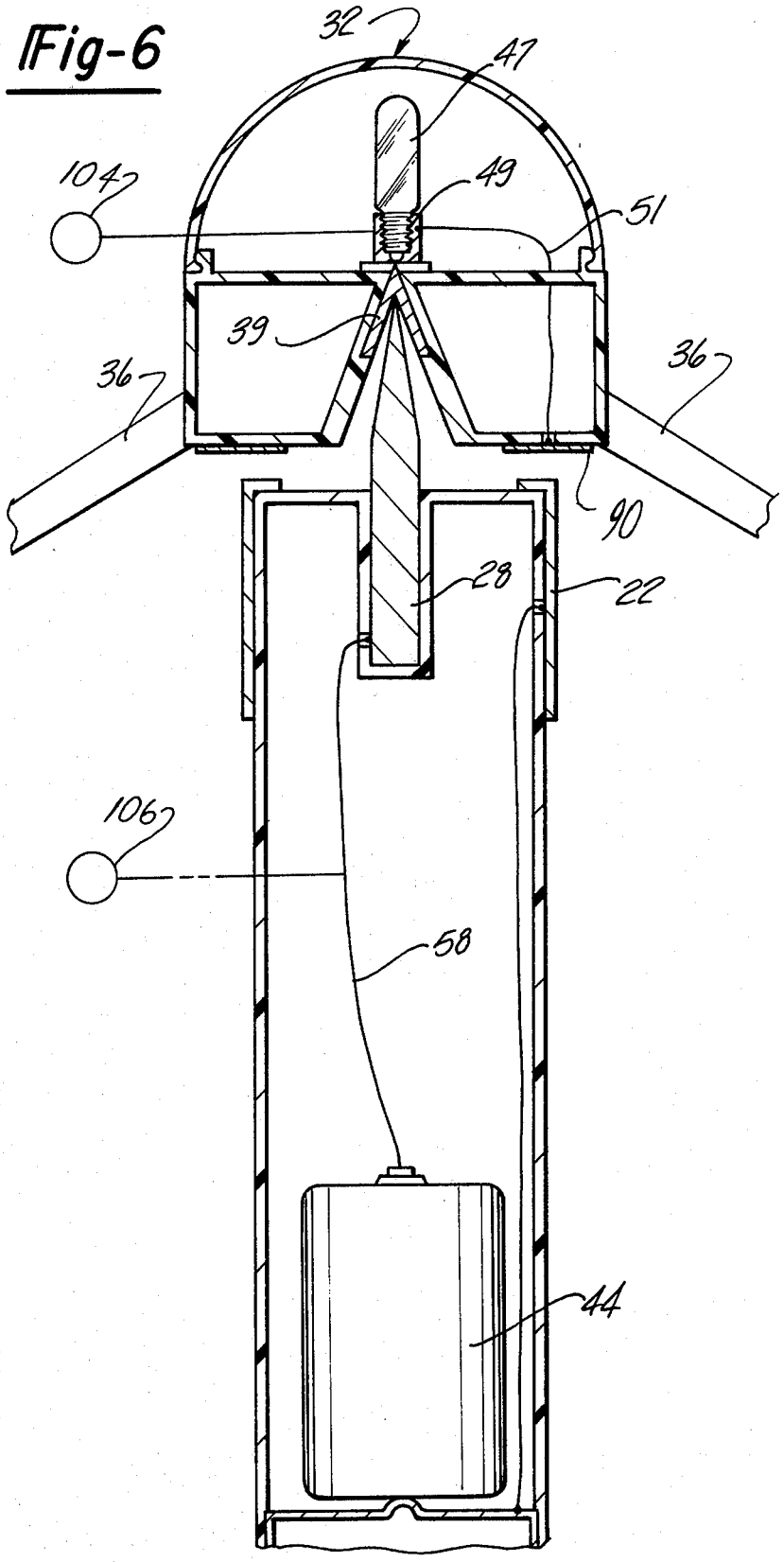
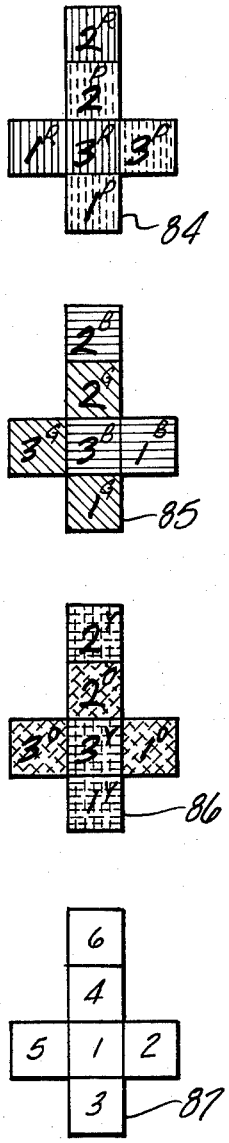
Fig-5

BALANCING GAME APPARATUS

BACKGROUND OF THE INVENTION

I. Field of the Invention

The present invention relates generally to games and is particularly directed to balancing games having weighted elements which may be suspended at various locations on extending arms of a balancing device.

II. Description of the Prior Art

Games of skill, chance, and strategy have been known and played over the years with a great variety of playing pieces and structures. However, few of these games combine the skill and strategy inherent in most games with the basic concepts of moments of force and balance as well as chance. Thus, such games when played in the past added little to the knowledge of the participants relative to moments of force and balance. There has been a need to provide a game with a balancing element which would give both enjoyment and instruction in mechanical moments of force. Furthermore, there has been a need to provide a game which can incorporate either a visual or audible alarm to detect an error or foul by the person attempting to maintain balance.

SUMMARY OF THE INVENTION

The present invention provides a game apparatus which involves a variable factor in maintaining balance by suspending weighted elements from a multiple of depending arms balanced atop a support column. The game provides both enjoyment and instruction in moments of force and balance.

The game is suitable for play by children five years of age and older, as well as by adults. The game may be simplified or made more difficult by the positioning of portions of the apparatus as well as by use of the accessories including colored dice and challenge cards.

The invention involves chance and comprises an apparatus for recreation and instruction in moments of force and balance. Various sets of colored and numbered dice may be used as random selection means.

The invention has a support base with a fulcrum such as a pointed portion on the top of the base to balance a balancing element comprising a hub and arms extending therefrom and positioned equidistantly about the hub. Each of the arms has a number of notches formed along the length thereof for the suspension of weights thereon. The weights are placed on the arm so that the hub and extending arms remain relatively balanced above the point on the fulcrum. The player-student learns balance by carefully placing the weights on the arms. The player of the game also learns about moments of force by placing the weights on the proper notches of appropriate arms so that the apparatus does not tip and close an electrical circuit which activates an indicating device such as a light or buzzer. A player obtains points for positioning the weights on the arms without setting off the indicator mechanism.

According to the rules of the game, the player receives a greater number of points for positioning the weights on a more extended portion of the arms. According to various alternative aspects of the game, the points which form electrical contacts or switch means in the apparatus may be moved relative to one another so that the relative skill required in positioning the weight is variable.

Various challenge cards may be used with the apparatus. These cards may, for example, show a starting position for weights on the extending arms and a desired finish position. The player is challenged to accomplish the desired arrangement in the fewest possible moves. Such cards may appear in books or as a newspaper/periodical item. Optionally, the cards may have a preferred sequence of steps for solution on the opposite side thereof.

Each of the extending arms are labelled with indicia such as colors and/or numbers. Dice or spinners may be used to determine which of the arms are to be used during one player's move. Optionally, another die may be used to determine how many of the weights are to be placed on the arms selected by the dice thrown to indicate which arms are to be used.

Preferably, each arm will have three notches cut angularly into the arm so that a weight hanging thereon slides naturally into the notch by gravity.

Also preferably, the notches are located at preselected positions on the arms so that various balance positions are possible. If a weight is placed on corresponding notches of opposing arms, for example the opposed outermost notches, balance is achieved. Furthermore, balance is achieved if two weights are placed at the innermost notch of an arm and one weight is placed at the central notch of the opposite arm. Finally, and preferably, balance is achieved if one weight is suspended on the outermost notch of an arm and three weights are suspended at the innermost notch of the opposing arm. So long as players are aware of the preselected balance positions for opposing arms, strategies may be planned for positioning or repositioning the weights.

The weights and notches formed thereon may be formed in any of various manners so long as the weights are capable of being retained on the arms without falling off. Thus, the weights may be of various shapes. A deck of challenge cards may also be associated with the games so that a player is challenged to place the apparatus in the configuration depicted or otherwise indicated on the card. Many other variations of the game are also possible.

At least three dice are associated with the game. The dice are formed with colored faces. Each die has only two colors associated therewith. The colors on the die represent extending arms attached to the central portion of the game apparatus. Thus, the extending arms are identified by colors equivalent with those on the dice. However, the two arms associated with the colors of one die are never positioned next to each other around the central portion atop the support column. For example, one die has three sides red and three sides purple, another die has three sides blue and three sides green, and the third die has three sides yellow and three sides orange. Thus, the extending arms, in the embodiment with six extending arms, are colored or otherwise identified as orange, yellow, blue, red, green, and purple. However, the arms are colored in such order that two colors associated with a single die are not located adjacent one another.

Preferably, the faces of each die have a number representation such as a numeral thereon. The preferred numerals are 1, 2, and 3. Thus, for example, one of the dice listed above will have the numeral 1 on one red face, the numeral 2 on the second red face, and the numeral 3 on the third red face, and similarly on the three purple faces. Thus each face of each die will not only be colored but will have a single numeral shown thereon. A roll of the above described dice thereby provides a random selection of not only the arms of the apparatus but also the number of weights to be used.

The dice are thrown to determine not only the number of weights which must be suspended on the extending arms of the game apparatus, but also to determine which of the extending arms must be used for balancing the game apparatus.

Play of the game with the weights and extending arms of the device not only requires skill and placement of the weights but also teaches the player moments of force where the weights are hung at various positions on notches along the extending arms. Since a weight position toward the outer portion of an arm exerts a greater moment of force on the central portion, thereby tending to close the circuit to end that player's turn, that position on the extending arm is worth more points for hanging a weight thereon. Thus, a player hangs the weights according to the dice thrown in his turn and, if completed without closing the electrical circuit by improperly balancing or positioning the weights on the extending arms, completes his turn and determines the number of points he has accumulated according to the positions and number of weights.

The game allows for adjustment of the structure of the balancing apparatus so that the contact points for the electrical circuit are more delicately movable and/or are spaced to a greater or lesser distance from each other.

Of course, use of an electrical system in a game also aids in the instruction of students and others about basic circuitry and electricity.

It is, therefore, an object of the present invention to provide a game apparatus which is not only entertaining but gives instructions in moments of force, balance, and electrical circuits.

It is also an object of the present invention to provide a game apparatus having dice which must be properly read by the game player and used to determine proper placement of weights on the balancing apparatus of the game.

It is also an object of the present invention to provide a game which has a signalling device of either the visual or audible type such that the game may be used by handicapped persons.

It is also an object of the present invention to provide an apparatus which is usable by player's of various ages and adjustable so as to meet the skills and knowledge of the players.

It is also an object of the invention to provide a game apparatus wherein challenge cards may also be associated therewith to determine the number of weights and relative position of weights which a player must use in a turn to accumulate points.

It is also an object of the present invention to provide a competitive game of relatively simple construction and easy operation by even the most elementary players.

It is also an object of the present invention to provide a game which may be of a basic design and structure but may otherwise be modified to represent a particular environment such as a space station and spacemen or an underwater station and divers, for example.

It is also an object of the present invention to provide a sturdy game apparatus for use by players of various ages wherein the apparatus may be easily disassembled for transportation and wherein the signalling portion of the apparatus may be removed and located remotely from the balancing portion of the game.

It is also an object of the present invention to provide a game apparatus with a signalling device associated therewith and positioned at any of several locations on the apparatus.

These and other objects of the present invention overcome the deficiencies of the game apparatus of the prior art. A better understanding of the present invention will be had upon a reading of the following description when read in conjunction with the accompanying drawings.

BRIEF DESCRIPTION OF THE DRAWINGS

FIG. 5 is a schematic representation of the dice associated with the present invention;

FIG. 6 is a sectional view of an alternative embodiment of the present invention having an indicator light in the top of the balancing element.

DESCRIPTION OF THE PREFERRED EMBODIMENT

Figure 1:
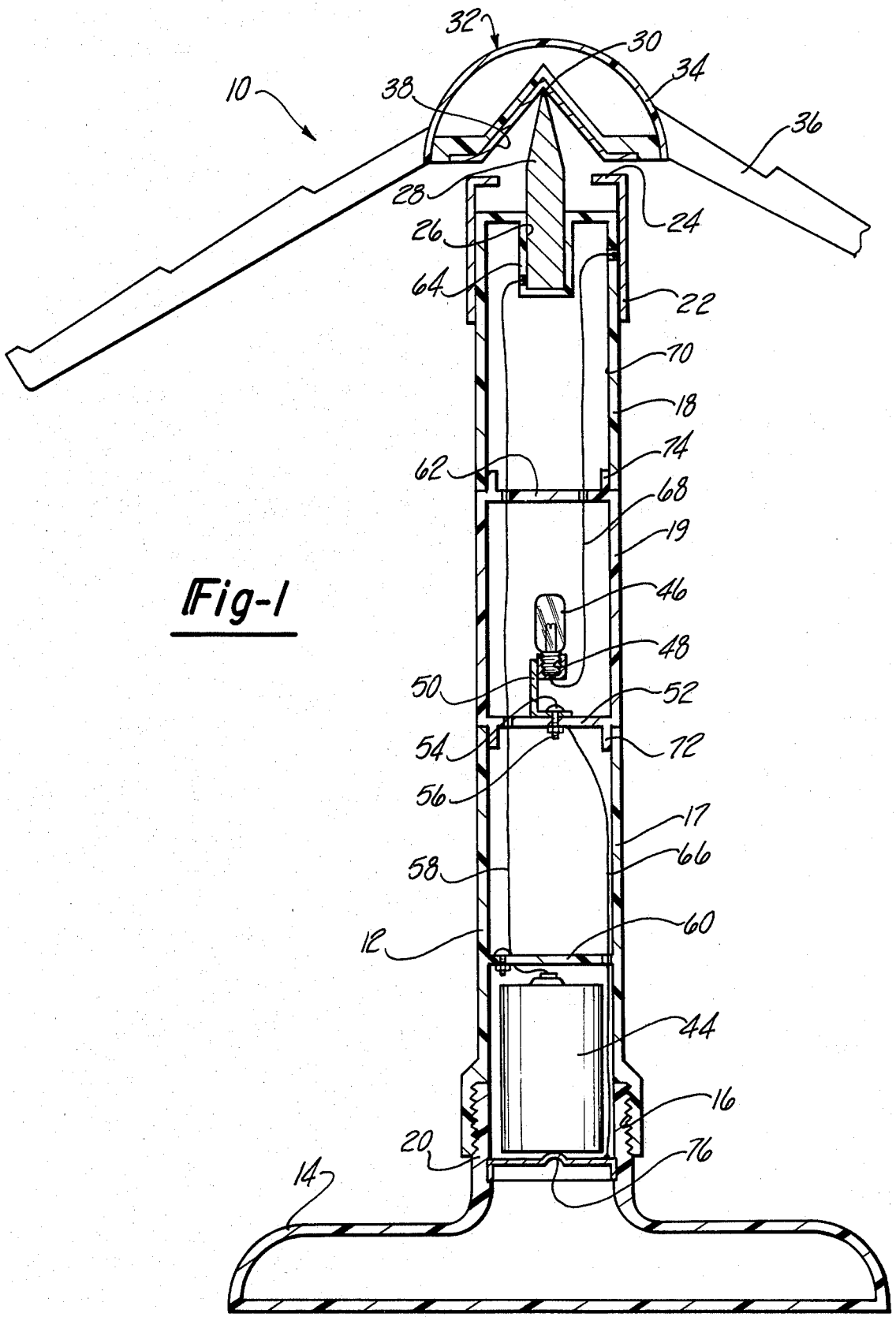
FIG. 1 is a section through the balancing apparatus of the present invention showing the stand, support column, balancing point, and central portion supported thereon.

Referring now to FIG. 1, the device 10 of the present invention includes a support base 12 having a threadably attached surface base section 14 by threads 16. The support base 12 also has an upper section 18, middle section 19, and lower section 17, which attaches to surface base section 14 at its doweled threaded end 20.

Figure 3:
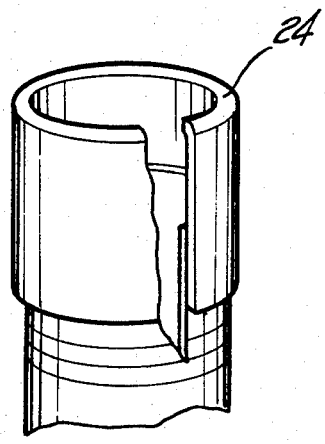
FIG. 3 is a fragmented perspective view of the adjustable feature of the support column.

Referring now also to FIG. 3, an adjustable collar 22 is slidably force fit onto the upper section 18 of the support base 12. The adjustable collar 22 is formed of an electrically conductive material for a reason to be stated later. As can be readily seen in FIG. 3, the collar 22 is adjustable to various heights so as to expose indicia for various skill levels of the game, such as lines 27. Alternatively, the collar may be threadably received on the upper section 18 of the support base 12. The adjustable collar 22 has a top depending flange 24 which provides a flat surface for electrical contact in a manner to be described hereinafter.

A chamber 26 is formed as part of upper section 18 to receive a fulcrum 28. The fulcrum depicted has a point 30 but may alternatively be formed as a rounded element. The fulcrum 28 may also be seen in FIGS. 2 and 4.

Balanced atop the fulcrum is a balancing element 32 having a hub 34 with a plurality of arms 36 depending therefrom at an angle of about 30° from the horizontal. Optionally, the arms may be formed so as to extend substantially horizontally to facilitate packaging of the parts of the apparatus. In the embodiment shown and described, six arms are preferred. Furthermore, the discussion of the rules and directions of the game will be given relative to the embodiment where the device has six arms depending in a manner described from the hub 34. The balancing element has a conical receptor 38 for mating engagement with the point 30 of fulcrum 28. The conical receptor 38 is lined or formed from an electrically conducting material for reasons explained below.

Figure 2:
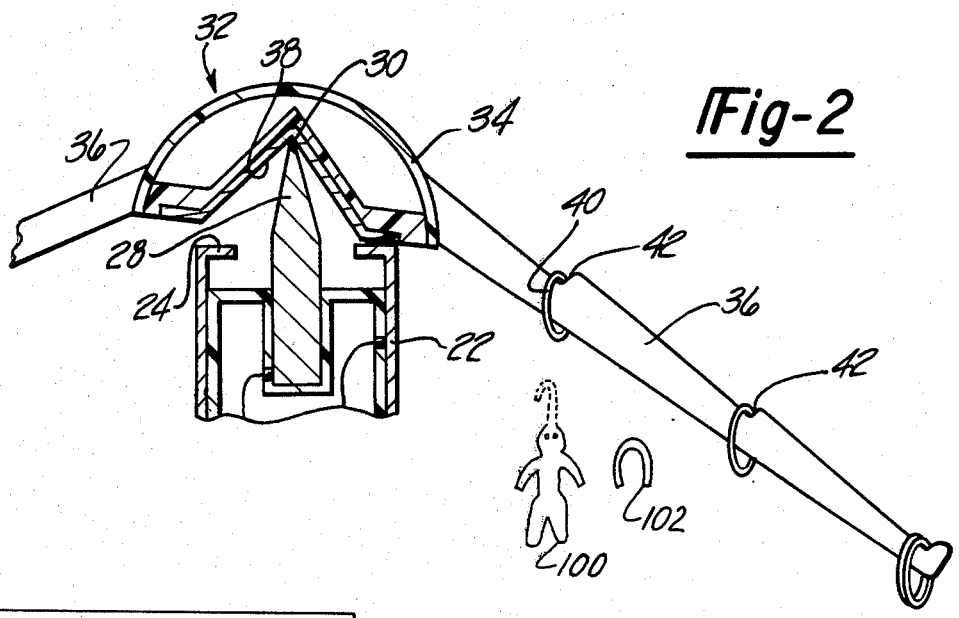
FIG. 2 is a fragmentary sectional view similar to FIG. 1 with weighted elements positioned on one of the extending arms.
Figure 7:
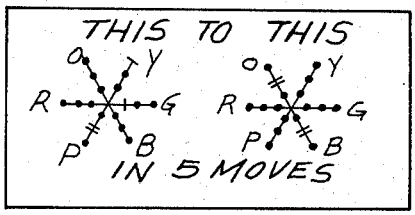
FIG. 7 is a top plan view of a challenge card used in conjunction with the balancing apparatus.

Referring now also to FIG. 2, weights 40 in the form of washers, each of substantially the same mass, are shown attached to arms 36 at various notches 42 formed along arms 36 at various positions. Each of the arms is formed in a similar manner. In an alternative manner of playing the game, the weights may be formed in a different shape, such as horseshoe shaped as shown in FIG. 3 at 102 or may be made with varying masses to vary the scoring of the game.

Referring again to FIG. 1, means are shown for indicating when the balancing element 32 has been overloaded in one direction. The means comprises an electrical circuit with a power source, electrical indicating means, and switch means. As shown in FIG. 1, the power source is a standard dry cell or cells 44. The electrical indicating means is a light 46 received in a small socket 48. The socket 48 is attached by means of an angle clip 50 which is bolted to horizontal wall section 52 of middle section 19 of the support base 12. A conventional bolt 54 and nut 56 may be used.

An electrical wire 58 is passed through a lower intermediate wall 60 of the support base 12 and then through horizontal wall 52 as well as intermediate wall 62 so as to thread through the wall portion 64 forming chamber 26 and touch the electrically conducting fulcrum 28. Similarly, a second wire 66 passes from contact 76 through the intermediate wall 60 of the support base 12 and is attached to the electrically conducting bracket 50 by means of bolt 54 and nut 56 so as to make contact with socket 48. Another wire 68 in turn leads from socket 48 through intermediate wall 62 of middle section 19 and thence through the side wall portion 70 of upper section 18. In this manner, a contact is formed from wire 68 to the electrically conductive collar 22 with its conductive upper flange 24. Thus, as can be seen from the circuitry shown in FIG. 1, a circuit is completed between the battery and the indicating means or light 46 when the electrically conductive lining of the conical receptor 38 is tipped so that a portion of said conical receptor is in contact with the upper flange 24 of the conductive collar 22, as shown in FIG. 2.

When too many weights 40 (FIG. 2) are placed on the arms 36 associated with one side of the balancing element 32, the balancing element 32 will tip to make contact between conical receptor 38 and upper flange 24 of the electrically conductive collar 22 thereby illuminating light 46. Of course, alternatively, an audible alarm such as a bell or buzzer, shown diagrammatically in FIG. 6 at 104, could be used in addition thereto or in place of the light 46.

As can be seen from the construction of the support base 12 shown in FIG. 1, the base is formed in various sections including upper section 18, middle section 19, and lower section 17 so that they may be fitted together by means of the force fitting caps formed on the ends thereof. For example, tabs 72 may be formed as either a full annular section or as individual tabs and extend to fit snugly within the side walls of section 17. Similarly, the tabs 74 will snugly fit into the side walls of upper section 18. Since the lower section 17 of support base 12 is easily threadably detached from the remainder of support base 12, the entire support base may be disassembled for easy storage or transportation.

In a similar manner, the arms 36 of balancing element 32 may be formed so as to be detachable from the balancing element 32 for ease of storage and transportation. Also, as can be seen, the fulcrum 28 may be formed so that it is removable from chamber 26 so as not to present a hazard.

A contact point 76 is formed so as to contact the negative terminal of dry cell 44. The contact is formed so as to fit into the side walls of lower section 17 and attach to wire 66 in the manner indicated such as by brazing or soldering.

Although a preferred embodiment is shown herein, it should be realized that various alternatives are available, such as, for example, placement of the electrical system outside of the support base 12 as shown diagrammatically at 106 in FIG. 6. Other embodiments are available so long as the electrical contact is available as a switch means between the balancing element 32 and the support base 12. Various formations of this electrical circuit are possible. In the manner shown and described in FIG. 1, the various sections of support base 12 may conveniently be made of different types of plastic whereby the portion containing light 46 is made of translucent plastic and the portion containing the battery, contacts, and wires of the invention are hidden by an opaque plastic. The collar 22 is conveniently made of a movable metal cylinder. A door may be formed in sections 17 and 19 for access to the electrical components.

FIG. 6 shows an alternative embodiment of the present invention. In this embodiment, the light 47 is positioned atop the balancing element 32 so that a circuit is completed from the cell 44 to wire 58 to fulcrum 28 to conical receptor lining 39 and thence to the socket 49 receiving light bulb 47. A wire 51 is required within element 32, as shown, between ring conductor 90 and socket 49.

Figure 4:
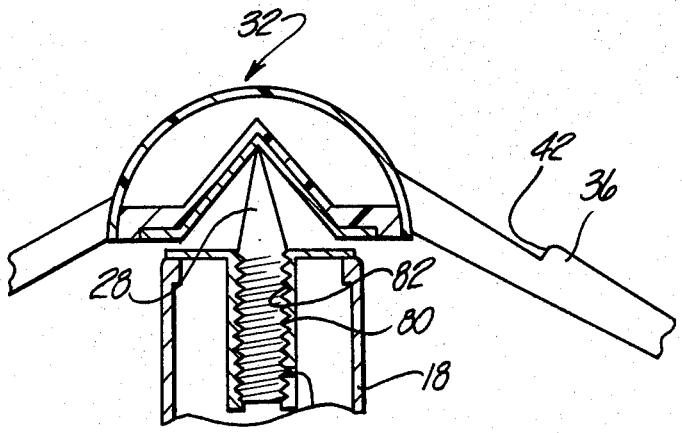
FIG. 4 is a fragmented view of an alternative embodiment of the fulcrum of the support column, shown in section.

A still further embodiment is shown in FIG. 4 where the fulcrum 28 is formed with external threads 80 and received in an internally threaded chamber 82 formed as a part of upper section 18.

FIG. 5 is a folded out view of the faces of the dice associated with the game. Dice 84, 85, and 86 are colored dice having the colors indicated in the table below and marked or otherwise depicted thereon.

| THE DICE | | |
|---|---|---|
| R = Red | P = Purple | B = Blue |
| G = Green | Y = Yellow | O = Orange |

As can be seen, the three colored dice 84, 85, and 86 have only two of the six colors associated with any one die. Each color appears on three faces of one die. According to the preferred embodiment of the invention, each of the arms 36 has a color associated therewith as an indicium for determining which of the arms 36 are to receive the weights according to the play of the game as described below. Thus, the adjacent arms of the game apparatus have indicia located according to the colored dice 84, 85, and 86 such that no three adjacent arms may be selected by a throw of the three colored dice 84, 85, and 86. Although two adjacent arms may be selected, they are never the two adjacent arms associated with a single die. Therefore, for the construction of the colored dice shown in FIG. 5 and embodiments shown in the other drawings, the arms may be sequentially labelled or otherwise given an indicia in the following order:

Red, Purple, Blue, Green, Yellow,
and Orange, in that order.

Preferably, the dice 84, 85, 86 also have the numerals 1, 2, and 3 indicated thereon as shown so that only these three dice are required to randomly select the arms and number of weights to be suspended. In this manner, only the notches remain to be selected according to the player's strategy.

Optionally associated with the game is a numbered die 87 which is shown schematically and folded out in FIG. 5. The die 87 is of a conventional type having an appropriate number of dots for the number represented by the face. Therefore, although numerals are shown in FIG. 5, a die of conventional construction and marking is also usable with the invention as is any equivalent thereof. The four dice may be thrown together, therefore, to determine which arms are to be selected for placement of the weights 40 and to determine the total number of weights which are to be suspended at any of the various notches 42 on the arms selected. Alternatively, additional numbered dice or various types of numbered dice may also be used to increase or decrease the number of weights which are to be used during a player's turn and suspended on the notches 42 of the arms 36.

In the manner of the construction presented above, a score is always obtainable without depriving a player of any points during a given turn. A more complete description of the rules and directions for the game is given hereinafter.

As an alternative to the dice, challenge cards are usable with the game. Each player draws a challenge card from a deck of cards to determine which configuration he will attempt to construct during his turn. Of course a lone player can use the apparatus with a challenge card. Other variations of selection of the number and placement of weights 40 are also possible. For example, a spinner having more than one indicator arrow and rotatable over a circular color board may be used to determine the number of weights and position at which they are to be suspended. According to this preferred embodiment of the invention, it is not necessary to determine which notch of the indicated arm is required for suspension of the weights 40.

An appropriate weight for each of the suspension weights 40 of the invention would be in the range of one to three ounces. Alternatively, weights of various masses may also be used. It should be realized from a discussion of the above that it is possible to arrange the colored dice and numbered dice so that the arrangement rolled on a given turn is not possible.

GENERAL GAME RULES

According to the preferred playing of the game apparatus of the present invention, a player may move only one weight at a time. That move may consist of either placing a weight onto one of the notches of the indicated arm or movement of the weight to a different notch on that arm. Thus, a player is required to exercise great skill in maintaining the balance of the balancing element 32 while at the same time comprehending the laws of physics related to moments of force. The weights on any arm may be moved in any direction as many times as the player chooses during his turn. However, once a weight has been put onto an arm, it may not be removed therefrom and put onto another arm or taken off of the balancing element completely.

A roll of the dice will determine who the first player is according to the highest total rolled. The first player thereafter rolls the colored dice 84, 85, 86 to determine, according to the indicia indicated, which arms are to be selected and how many weights are to be placed on those arms. The player then places the weights (or moves the weights) one at a time on the colored arms 36 of the apparatus indicated by the colored dice.

The weights must be put on each arm indicated by the colored dice. If the number one is rolled with the red face of a die, the player may choose which notch 42 at which he wishes to position the weight on the "red" arm. Similarly, if the number two is rolled on the orange face of a die, the player chooses the notches of "orange" arm 36 on which he wishes to place weights 40. Of course, the player may rearrange the weights on an arm one at a time to achieve a maximum score since more points are given for positioning a weight at the outermost notch of an arm 36.

For example, three points are given for the outermost of three notches on a given arm, two points for the central notch on a given arm, and one point for the inner notch of the arm. This, of course, is attributable to that law of physics associated with moments of force, that is, weight times distance from the fulcrum determines the moment of force. Since a player who suspends a weight at the outermost notch of a given arm creates a greater moment of force against the opposite side of the balancing element 32, more points are given for such a suspension of a weight 40.

If, at any time during a player's turn, the light becomes illuminated, whether due to poor handling of the weights and balancing element 32 or due to the improper placement of weights according to the moments of force created thereby, the player terminates his turn and receives no points for that turn. At that point, the next player in turn rolls the four dice to determine how many and which arms of the device he will use.

Once a player has touched a weight, he must move that weight, either off from the arm or to a different location on the arm. Also, a player must announce that he has reached the end of his turn to accumulate points.

The game is suitable for play by players age five or older. Any number of players can play, but the time between turns becomes longer with each added player and the complication of the game with the increased number of dice also extends the time of each turn. A score of 75 points or any other value selected and agreed upon by the players determines the winner. Alternatively, the winner may be named at the end of three rounds of play, for example.

Another embodiment of the game apparatus, the balancing element and support base may be formed with the appearance of a space station. Thus, the weighted elements may be formed as spacemen 100 as shown in phantom lines in FIG. 3 or similar elements associated with an outer space environment so as to add an attraction to the game for younger players and others interested in space exploration.

Having described my invention, it will become apparent to those skilled in the art to vary the materials and arrangement of some of the parts of the game including the means for selecting the arms to support weighted elements and the means for selecting the number of weights to be balanced on the arms, without departing from the scope or spirit of the invention as defined by the appended claims.

What I claim is:

1. A game apparatus for recreation and instruction in moments of force and balance, said apparatus comprising:

a support base having a fulcrum at the top;

a balanced element having a plurality of equidistantly spaced, extending arms, said element being balanced on said fulcrum, each of said plurality of arms having a plurality of notches formed therealong, and each of said plurality of arms having a separate indicium;

a plurality of weights to be suspended from said plurality of arms at any of said notches;

means for randomly selecting a plurality of indicia to determine which arms are to suspend said weights;

means for determining the number of said weights to be suspended on said arms; and means for indicating when said balanced element is imbalanced beyond a predetermined point, whereby a player may accumulate points for properly positioning a number of weights on said arms according to said weight determining means and said random selecting means thereby learning about balance and moments of force.

2. The invention as defined in claim 1 wherein said indicating means comprises a power source, electrical indicating means, and switch means for selectively connecting said power source to said electrical indicating means when said balanced element is imbalanced beyond a predetermined point due to the positioning of weights in notches on the arms.

3. The invention as defined in claim 2 wherein said power source is a battery and said electrical indicating means is an electric light.

4. The invention as defined in claim 3 wherein said battery and said light are contained in said base.

5. The invention as defined in claim 3 wherein said light is attached to said balanced element.

6. The invention as defined in claim 2 wherein said balanced element further comprises a central hub having said arms extending therefrom, said hub having a conical receptor receiving said fulcrum to support said balanced element.

7. The invention as defined in claim 6 wherein said switch means further comprises a first electrical contact formed around said hub and a second electrical contact disposed around said base near said fulcrum so as to cooperate with said first contact and close the circuit between said power source and said electrical indicating means when said balanced element is imbalanced beyond a predetermined point.

8. The invention as defined in claim 7 and further comprising means for selectively varying the proximity of said first electrical contact and said second contact.

9. The invention as defined in claim 8 wherein said proximity varying means comprises a collar disposed about said base near said fulcrum, said collar having said second electrical contact thereon and being adjustable along the height of said base.

10. The invention as defined in claim 8 wherein said fulcrum is externally threaded and received in a threaded coaxial bore in said base so as to be adjustable whereby the height of said hub above said base is infinitely variably adjustable to change the proximity of said contacts.

11. The invention as defined in claim 2 wherein said electrical indicating means comprises an audible alarm.

12. The invention as defined in claim 2 wherein said power source and at least a portion of said switch means are positioned remotely from said support base.

13. The invention as defined in claim 1 wherein said plurality of arms comprises six arms depending at an angle between the horizontal and about thirty degrees below the horizontal, each arm having three notches formed therealong for suspending weights.

14. The invention as defined in claim 13 wherein said random selecting means further comprises three color dice, each indicium is a color, and each die has, on each face thereof, one of two of the indicia colors corresponding to adjacent arms so that each of the six colors is found on at least one face of a die but not on different dice whereby three adjacent arms of the six arms will not be selected on a roll of the dice.

15. The invention as defined in claim 14 wherein the first of said three color dice has three preselected faces of a first predetermined color, one of said three preselected faces has a numeral 1 thereon, another of said preselected faces has a numeral 2 thereon, and the third of said preselected faces has the numeral 3 thereon; said first of the three color dice also having three faces of a second predetermined color which likewise have the numerals 1, 2, and 3 thereon; the other two of said three color dice being similarly formed.

16. The invention as defined in claim 12 wherein said number determining means comprises at least one number die having the numbers one through six each represented on a face thereof so that a roll of said at least one die determines additional weights to be suspended on any of the arms selected by said color dice thereby including a further element of chance in the game.

17. The invention as defined in claim 1 wherein said weights are horseshoe shaped.

18. The invention as defined in claim 1 wherein said weights are washer shaped.

19. The invention as defined in claim 1 and further comprising a deck of challenge cards to be used with said game, each of said cards indicating a configuration of weights suspended on the arms.

20. The invention as defined in claim 1 and further comprising suspension elements having a different mass than said weights.

21. The invention as defined in claim 1 wherein said support base is formed in at least two sections and further comprising means for detachably securing said sections together.

22. The invention as defined in claim 1 and further comprising means for removably securing said fulcrum to said support base.

23. The invention as defined in claim 1 and further comprising means for detachably securing each of said arms to said balance element.

24. The invention as defined in claim 1 wherein each weight is formed so as to simulate the form of a spaceman.

* * * * *